United States Patent [19]

Factor et al.

[11] Patent Number: 4,855,221

[45] Date of Patent: Aug. 8, 1989

[54] PHOTOGRAPHIC ELEMENTS HAVING OXONOL DYES

[75] Inventors: Ronda E. Factor; Donald R. Diehl, both of Rochester, N.Y.

[73] Assignee: Eastman Kodak Company, Rochester, N.Y.

[21] Appl. No.: 73,257

[22] Filed: Jul. 13, 1987

[51] Int. Cl.[4] ..... G03C 1/84

[52] U.S. Cl. ..... 430/510; 430/512; 430/517; 430/522

[58] Field of Search ..... 430/510, 512, 517, 522

[56] References Cited

U.S. PATENT DOCUMENTS 3,795,519 3/1974 Miyazako et al. ..... 96/84 A
4,092,168 5/1978 Lemahieu et al. ..... 96/84 R

FOREIGN PATENT DOCUMENTS 0141298 9/1984 European Pat. Off. .
1414456 11/1975 United Kingdom .
2138961 10/1984 United Kingdom .

OTHER PUBLICATIONS

Weast Handbook of Chemistry and Physics C169 and C174 and C74, (1971).

*Primary Examiner*—Jack P. Brammer
*Attorney, Agent, or Firm*—Paul L. Marshall

[57] ABSTRACT

Photographic elements having oxonol dyes of the formula:

$R^1$ and $R^2$ each independently represent alkyl of from 1 to 5 carbon atoms are disclosed. The dyes are particularly useful as filter dyes in the form of solid particle microcrystalline dispersions.

4 Claims, 2 Drawing Sheets

PHOTOGRAPHIC ELEMENTS HAVING OXONOL DYES

RELATED APPLICATIONS

Cross reference is made to the application entitled "Microcrystalline Dye Dispersions for Photographic Filter Layers", Ser. No. 945,634, filed Dec. 23, 1986 in the name of R. E. Factor and D. R. Diehl.

FIELD OF THE INVENTION

This invention relates to photographic elements containing dyes useful as filter dyes.

BACKGROUND OF THE INVENTION

Filter dyes in a photographic element may be located in a number of locations in the element, such as a radiation-sensitive layer, an overcoat layer, a layer adjacent to a radiation-sensitive layer, an interlayer of a multilayer element, an undercoat layer adjacent to a support, or in a backing layer on the side of the support opposite the radiation-sensitive layer.

When incorporated directly in the radiation-sensitive layer, filter dyes can improve sharpness by absorbing light scattered from one silver halide grain to another. Such dyes are referred to as absorber dyes. Filter dyes also function to retard the sensivitiy of one light sensitive layer relative to another in a multilayer element. By absorbing some of the exposing radiation, the filter dye aids in balancing the sensitivities of all the light sensitive layers.

Filter dyes that function primarily to absorb unwanted radiation due to reflection or refraction from layer interfaces, the layer-support interface, and particularly from the back side of the support, are referred to as antihalation dyes. The layers that contain them are referred to as antihalation layers.

There are a variety of uses for filter dyes and filter layers. For example, a filter layer may be used in or near the overcoat layer to protect the light sensitive layer against radiation from certain spectral regions. In multilayer films where there may be two or more light sensitive layers, it may be necessary to have filter dye interlayers.

It is important that the dyes remain in the layer and not wander or diffuse into the adjacent layers. It is also important for the dyes to be completely decolorized or removed from the element, or both, usually during processing, after having performed their function. Dye stability, especially under high temperature and high humidity incubation is also important. In many cases where absorption of light in a certain spectral region but not the adjacent spectral region is desired it is highly desirable if the filter dye has a steep absorption peak, i.e., the dye is "sharp cutting".

There are a number of problems associated with filter dyes in general and their use in filter layers in photographic elements. Dyes in filter layers can sometimes wander or diffuse into adjacent layers. This can cause problems such as speed loss or stain in the adjacent layers. Filter dyes should be easily decolorized or washed out of the element or both during processing after they have performed their function. When they remain in the element as colored dyes, they cause stain, which adversely affects image quality. This problem can be aggrevated by the use of a polymer mordant in a filter layer to prevent dye wandering.

It is therefore highly desirable to provide a filter dye that has a sharp-cutting absorbance peak, does not wander prior to processing, and washes out easily during processing, leaving little or no residual stain.

SUMMARY OF THE INVENTION

The invention provides photographic elements comprising a dye having a sharp-cutting absorbance peak, that does not wander prior to processing, and that washes out easily, leaving little or no stain. The dye of the invention has the formula:

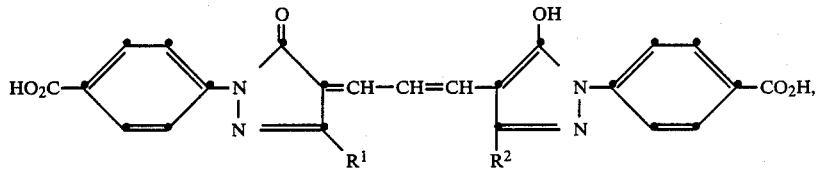

wherein $R^1$ and $R^2$ each independently represent alkyl of from 1 to 5 carbon atoms, and The dyes of the invention provide an absorbance curve with a sharp cut-off. At coating pH's of 7 or less, the dyes tend to be insoluble and indiffusible in hydrophilic colloid layers, eliminating the requirement of a mordant to prevent wandering. At processing pH's of 8 or more, the dyes tend to become soluble and are highly diffusible in hydrophilic colloid layers, leading to a high degree of washout with little or no residual stain.

DESCRIPTION OF THE PREFERRED EMBODIMENTS

Figure 1:
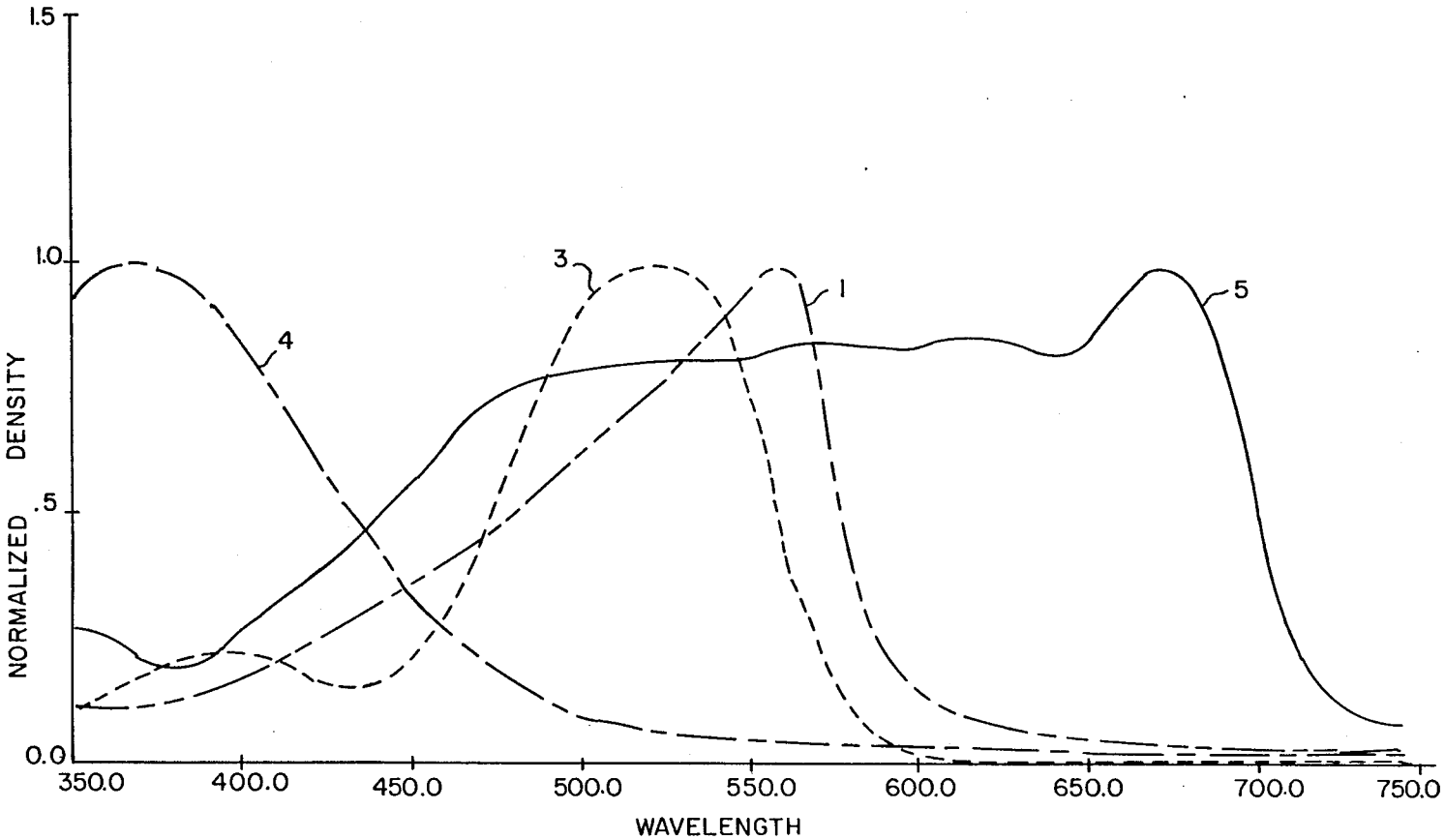
FIG. 1 represents the sharp-cutting absorbance peak of an element comprising a dye according to the invention compared to elements and dyes outside the scope of the invention.

Preferred dyes according to the invention are given below in Table I.

TABLE I

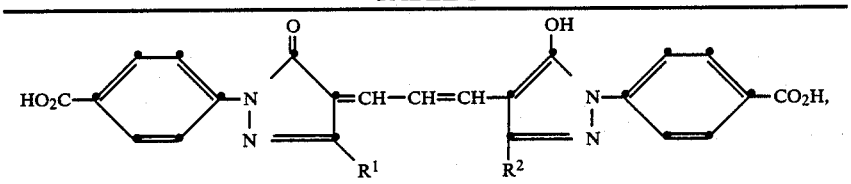

wherein

| Dye | $R^1$ | $R^2$ |
|---|---|---|
| 1 | $CH_3$ | $CH_3$ |
| 2 | $C_2H_5$ | $C_2H_5$ |

The dyes according to the invention are prepared by well-known techniques, such as those described in U.S. Pat. No. 2,274,782 as well as other literature. Their preparation is further described in the Examples below.

The dyes of the invention are preferably in the form of a solid particle microcrystalline dispersion for incorporation into a layer such as a hydrophilic colloid layer coated on a photographic element. The dyes may be located in any layer of the element where it is desirable to absorb light, but it is particularly advantageous to locate them in a layer where they will be solubilized and washed out during processing. The dye is preferably present in an amount of from 1 to 1000 mg/ft$^2$. The microcrystalline dispersion can be formed by precipitating the dye in the form of a dispersion and/or by well-known milling techniques, e.g., ball-milling, sand-milling, or colloid-milling the dye in the presence of a dispersing agent. The dye particles in the dispersion should have a mean diameter of less than 10 μm and preferably less than 1 μm. The dye particles can be conveniently prepared in sized ranging down to about 0.01 μm or less.

The dyes of this invention are useful in black and white, single color, multicolor, or X-ray photographic elements.

Multicolor elements contain dye image-forming units sensitive to each of the three primary regions of the spectrum. Each unit can comprise a single emulsion layer or of multiple emulsion layers sensitive to a given region of the spectrum. The layers of the element, including the layers of the image-forming units, can be arranged in various ways as known in the art. In an alternative format, the emulsions sensitive to each of the three primary regions of the spectrum can be in a single segmented layer, e.g., as by the use of microvessels as described in Whitmore U.S. Pat. No., 4,362,806, issued Dec. 7, 1982.

A typical multicolor photographic element would comprise a support bearing a cyan dye image-forming unit comprising a red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitivie silver halide emulsion layer having associated therewith at least one yellow dye-forming coupler. The element can contain additional layers such as other filter layers, interlayers, overcoat layers, subbing layers, and the like.

In the following discussion of suitable materials for use in the emulsions and elements of this invention, reference is made to *Research Disclosure,* December 1978, Item 17643, published by Kenneth Mason Publications, Ltd., The Old Harbourmaster's 8 North Street, Emsworth, Hampshire P010 7DD, ENGLAND, the disclosures of which are incorporated herein by reference. This publication will be identified hereafter by the term "Research Disclosure".

The silver halide emulsions employed can be either negative-working or positive-working. Suitable emulsions and their preparation are described in *Research Disclosure* Sections I and II, or in *Research Disclosure,* January, 1983, Item 22524, or in U.S. Pat. No. 4,425,426, which is incorporated herein by reference in its entirety, and the publications cited therein. Suitable vehicles e.g., a hydrophilic colloid such as gelatin, for the emulsion layers and other layers are described in *Research Disclosure* Section IX and the publications cited therein.

In addition to couplers, the elements can include additional couplers as described in *Research Disclosure* Section VII, paragraphs D, E, F and G and the publications cited therein. These couplers can be incorporated in the elements and emulsions as described in *Research Disclosure* Section VII, paragraph C and the publications cited therein.

The photographic elements or individual layers thereof can contain brighteners (see Research Disclosure Section V), antifoggants and stabilizers (see *Research Disclosure* Section VI), antistain agents and image dye stabilizer (see *Research Disclosure* Section VII, paragraphs I and J), light absorbing and scattering materials (see *Research Disclosure* Section VIII), hardeners (see *Research Disclosure* Section XI), plasticizers and lubricants (see *Research Disclosure* Section XII), antistatic agents (see *Research Disclosure* Section XIII), matting agents (see *Research Disclosure* Section XVI) and development modifiers (see *Research Disclosure* Section XXI).

The photographic elements can be coated by any of a number of well-known techniques, as described in *Research Disclosure* Section XV.

The photographic elements can be coated on a variety of supports, as described in *Research Disclosure* Section XVII and the references described therein.

Photographic elements can be exposed to actinic radiation, generally in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

The practice of the invention is further illustrated by the following examples:

EXAMPLES

The starting materials used in these examples are either commercially available or readily prepared by one of ordinary skill in the art.

EXAMPLE 1

Preparation of an Element having a filter layer of 1,3-bis [(1-(4-carboxyphenyl)-3-methyl-2-pyrazolin-5-one-4]trimethine oxonol (dye 1 of Table I)

Step 1—Preparation of the Sodium Salt of the Dye

Trimethoxypropene (8.0 g), 1-(p-carboxyphenyl)-3-methylpyrazolone (21.8 g), ethanol (100 ml), and triegthylamine (14.6 g or 20 ml) were combined and boiled under reflux for 30 minutes. The mixture was chilled and then combined with 200 ml methanol, then 40 ml concentrated hydrochloric acid. A red precipitate formed immediately. The mixture was stirred at room temperature for 15 minutes and filtered. The precipitate was washed with 300 ml ethanol, 1000 ml methanol, 1000 ml ether, and then air dried to yield a dry weight of 12.4 g.

The precipitate containing the dye was then purified through a number of washing and dissolution/recrystallization steps. The precipitate was first slurried in 500 ml refluxing glacial acetic acid, cooled to room temperature, filtered, washed with 250 ml acetic acid, 250 ml $H_2O$, 250 ml methanol, and then dried. It was then dissolved in 100 ml hot dimethylsulfoxide and cooled to 40° C. 300 ml methanol was added, upon which a red precipitate formed, which was filtered, washed with methanol, acetone, and ligroin, and dried. This precipitate was dissolved in 200 ml methanol and 6 ml (4.38 g) triethylamine and heated to reflux. 4.8 ml of concentrated hydrochloric acid was added and a fine red precipitate was formed. The solution was filtered while hot and the precipitate was washed with methanol and acetone and dried. The precipitate was then dissolved in a refluxing mixture of 200 ml ethanol and 6.0 ml (4.38 g) triethylamine. 9.0 g of sodium iodide dissolved in 50 ml methanol was added. Upon cooling to room temperature, a red precipitate formed. The mixture was chilled in ice for one hour, then filtered. The precipitate was washed with ethanol, ligroin and dried to yield the sodium salt of dye 1.

Step 2—Preparation of the Dye

The sodium salt from Step 1 was dissolved in 200 ml water with rapid stirring. 6.0 ml concentrated hydrochloric acid was added and a fluffy red precipitate formed. The mixture was filtered and the precipitate was washed with water, methanol, acetone, and ligroin, and dried to yield dye 1.

Step 3—Preparation of the Element 1.0 g of the dye from Step 2 was placed in a 60 ml screw-capped bottle along with 21.7 ml water, 2.65 g Triton X-200 ® (available from Rohm & Haas), and 40 ml of 2 mm diameter zirconium oxide beads. The bottle with the cap secured was placed in a Sweco ® mill and the contents were milled for four days. The container was removed and the contents added to 8.0 g of an aqueous gelatin solution (12.5% by weight of gelatin). This mixture was placed on a roller mill for 10 minutes to reduce foaming and then filtered to remove the zirconium oxide beads.

A spreading agent (surfactant 10G ®, available from Olin Chemical) and a gelatin hardener (bis(vinyl-sulfonylmethyl)ether) were added to the above-prepared dye-gelatin melt. A melt prepared from this mixture was coated on a poly(ethylene terephthalate) support to achieve a dye coverage of 0.32 g/m$^2$, gelatin coverage of 1.60 g/m$^2$, spreading agent coverage of 0.096 g/m$^2$, and hardener level of 0.016 g/m$^2$.

EXAMPLE 2

Sharp-Cutting Absorbance Peak of Dyes of the Invention

Five elements were prepared as in Example 1, each using one of the dyes of Table II.

TABLE II

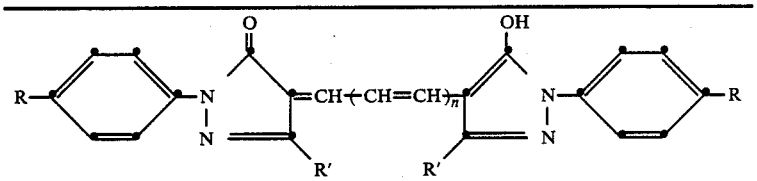

| | Dye | n | R | R' |
|---|---|---|---|---|
| 1 | (Same as Example 1 Step 3) | 1 | $CO_2H$ | $CH_3$ |
| 2 | | 1 | $CO_2H$ | $C_2H_5$ |
| 3 | (Comparison dye - Same as Example 1 Step 2) | 1 | $CO_2Na$ (Not a microcrystalline dispersion since soluble at coating pH) | $CH_3$ |
| 4 | (Comparison dye) | 0 | $CO_2H$ | $CH_3$ |
| 5 | (Comparison dye | 2 | $CO_2H$ | $CH_3$ |

Figure 2:
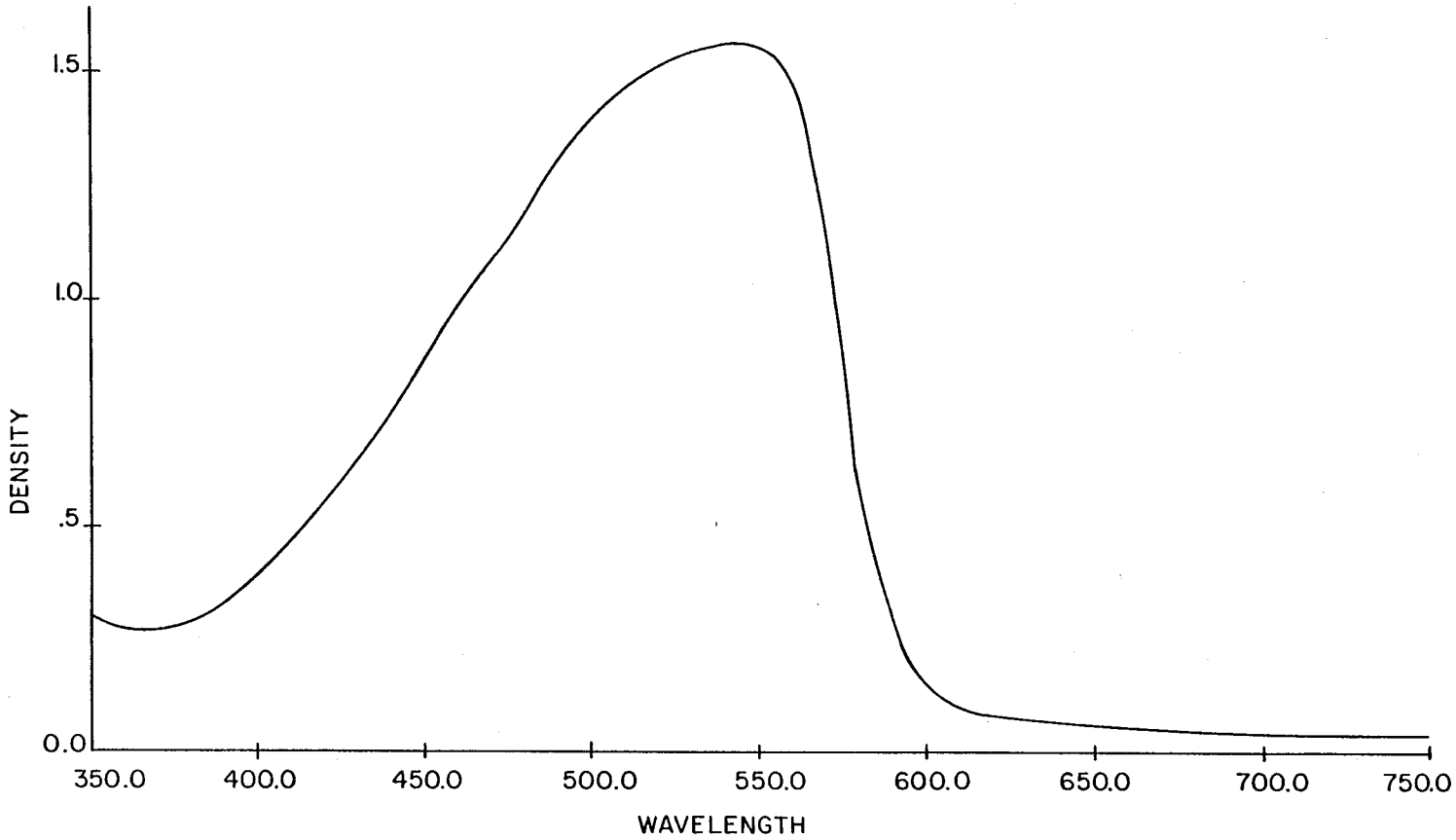
FIG. 2 represents the sharp-cutting absorbance peak of an element comprising a dye according to the invention.

The absorbance spectrum of each of these elements was measured using a spectrophotometer. These spectra are shown in FIGS. 1-2. In FIG. 1, curve 1 represents the absorbance spectrum for the element coated with dye 1, curve 3 for the dye 3 element, curve 4 for the dye 4 element, and curve 5 for the dye 5 element. FIG. 1 shows that the absorbance spectrum for the element coated with dye 1 is much more sharply cutting than any of the others. FIG. 2 represents the sharp-cutting absorbance spectrum for the element of the invention coated with dye 2.

EXAMPLE 3

Dye Wandering and Washout Characteristics of Elements of the Invention

The elements of Example 2 containing dyes 1–3 were washed with distilled water for five minutes and then processed as indicated in Table III. Optical density at λ-max was measured before and after the wash step and again after processing. The results are presented in Table III.

TABLE III

| Dye | Density Before Washing or Processing | Density After Washing | Density After Processing | Process Type |
|---|---|---|---|---|
| 1 | 2.21 | 2.22 | 0.02 | Kodak Prostar ® Process |
| 1 | 2.21 | 2.22 | 0.01 | Kodak E-6 ® Process |
| 2 | 1.57 | 1.54 | 0.03 | Kodak Prostar ® Process |
| 2 | 1.57 | 1.54 | 0.01 | Kodak E-6 ® Process |
| 3 | 1.11 | 0.02 | 0.01 | Kodak Prostar ® Process |
| 3 | 1.11 | 0.02 | 0.01 | Kodak E-6 ® Process |

In Table III, the small change between optical density before washing and optical density after washing in elements of the invention indicates that little or no dye wandering took place. The very low optical density after processing indicates almost complete washout, with little or no residual stain.

The invention has been described in detail with particular reference to preferred embodiments thereof, but it will be understood that variations and modifications can be effected with the spirit and scope of the invention.

What is claimed is:

1. A photographic element comprising a support having thereon a radiation-sensitive silver halide emulsion layer and a layer, which is the same as or different from the silver halide layer, comprising a hydrophilic colloid and an amount effective as a photographic filter dye of a solid particle dispersion of a compound having the formula:

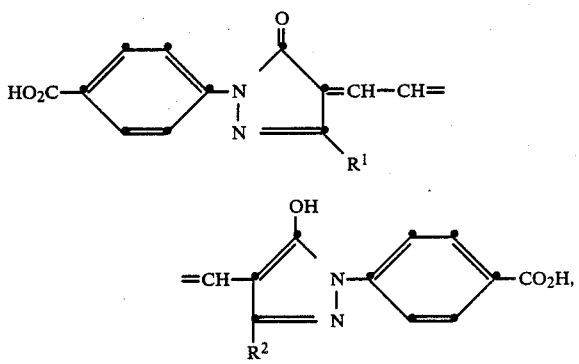

wherein $R^1$ and $R^2$ each independently represent alkyl of from 1 to 5 carbon atoms, the particles of said dispersion having a mean diameter of between about 0.01 and 10 μm.

2. A photographic element according to claim 1 wherein said particles have a mean diameter of between about 0.01 and 1.0 μm.

3. A photographic element according to claim 1 wherein said dye is present in an amount of from about 1 to 1000 mg/ft$^2$.

4. A photographic element according to claim 1 wherein $R^1$ and $R^2$ are each independently methyl or ethyl.

* * * * *